United States Patent [19]

Shearer

[11] 4,174,093

[45] Nov. 13, 1979

[54] GRIPPER JAW

[75] Inventor: Thomas R. Shearer, Ligonier, Pa.

[73] Assignee: Kennametal Inc., Latrobe, Pa.

[21] Appl. No.: 901,247

[22] Filed: Apr. 28, 1978

[51] Int. Cl.[2] ..... E21B 19/00

[52] U.S. Cl. ..... 254/29 R

[58] Field of Search ..... 254/29 R, 30, 31, 133; 81/180 B, 186; 269/257, 265, 271, 283

[56] References Cited

U.S. PATENT DOCUMENTS

| | | | |
|---|---|---|---|
| 1,541,225 | 6/1925 | Kaough | 81/180 B |
| 2,162,216 | 6/1939 | Harris | 81/186 |
| 3,227,419 | 1/1966 | Lackey | 254/29 R |

*Primary Examiner*—Robert C. Watson

*Attorney, Agent, or Firm*—Lawrence R. Burns

[57] ABSTRACT

Disclosed herein is a gripper jaw for a driving, extracting head. The gripper jaw is comprised of a block-like body of metal with a front face and a back face adapted for attachment to a power-driven arm. The front face has wear resistant compacts with one end imbedded in the front face and the other end of the compact protruding beyond the front face.

6 Claims, 4 Drawing Figures

GRIPPER JAW

BACKGROUND OF THE INVENTION

This invention relates to gripper jaws used with hydraulic vibratory equipment for driving or extracting piling and caissons.

Hydraulic vibratory equipment for driving and piling caissons are known in which the power-driven vibratory head is suspended from a crane and has a pair of power-driven arms that come together and can form a vise-like grip on pilings, caissons and the like.

Once the vibratory head has a vise-like grip on the piling, the vibratory motion of the head aids in either driving the pile inward or extracting a pile from its location. Significant in the success of the driving or extracting work is the vise-like grip that the arms form on the member to either be extracted or driven, usually into an earth formation.

Heretofore, the gripper plates have comprised blocks of metal, some of which have presented knurled surfaces to the piling member or caisson upon which the work was to be performed. While such a gripper jaw may be adequate in the beginning, and may possibly last for a certain period of time, gripper jaws made of metal, and with knurled surfaces, wear quickly when used in such a manner, causing the vibratory head to lose its vise-like grip upon its work member.

BRIEF SUMMARY OF THE INVENTION

According to the present invention, a pair of gripper jaws for driving an extractor head is provided with a gripper jaw comprising a block-like metal body having a front face for engaging the work member and a back face adapted to be mounted upon a power-driven arm. The front face of the block-like metal body has wear resistant compacts imbedded therein with one end of the compacts protruding beyond the front face of the metal body.

Preferably, the protruding part of the compact is conically shaped so that several pointed portions of the compacts dig in and engage the work member. Compacts are preferably made from a cemented hard metal carbide material, such as a tungsten carbide. The compacts are further rod-like in configuration with a portion of the rod-like configuration imbedded in the front face of the gripper jaw.

It is an object of the present invention to provide an improved and superior gripper jaw body for use with a driving, extracting, vibratory head.

It is a further object of the present invention to increase the friction hold of the vise-like grip of the power-driven arms upon the work member when using hydraulic vibratory equipment.

The exact nature of the present invention will become more clearly apparent upon reference to the following detailed specification taken in connection with the accompanying drawings in which:

DETAILED DESCRIPTION OF THE INVENTION

Figure 1:
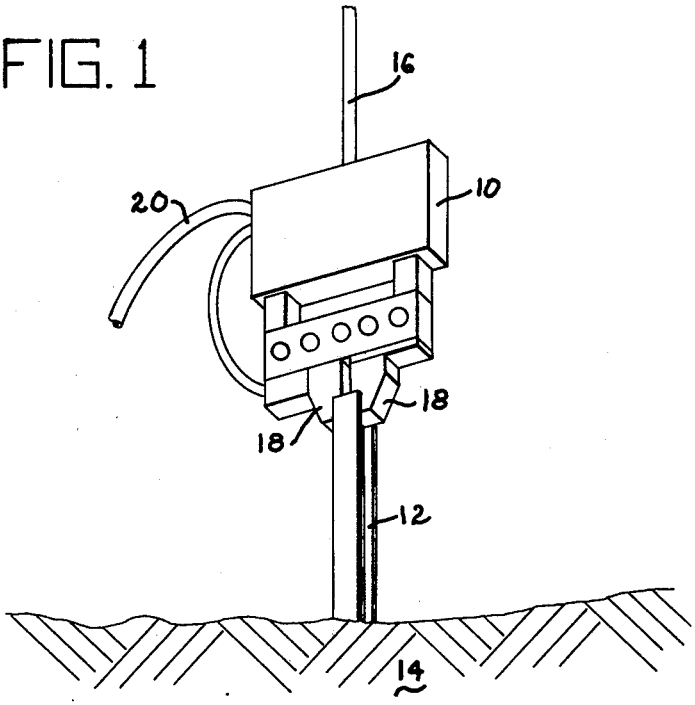
FIG. 1 is a perspective view of a vibratory power head gripping an I-beam.

Referring to the drawings somewhat more in detail, shown in FIG. 1 is a vibratory head 10 which is used for driving or extracting I-beams or piles 12 into earth formations 14. The vibratory head is suspended from a crane by cable 16 and has a pair of movable arms 18 that are slidable linearly in and out on the vibratory head 10.

The arms 18 may be powered by hydraulic force, such as 20, so as to provide a vise-like grip on the pile or I-beam 12.

Figure 2:
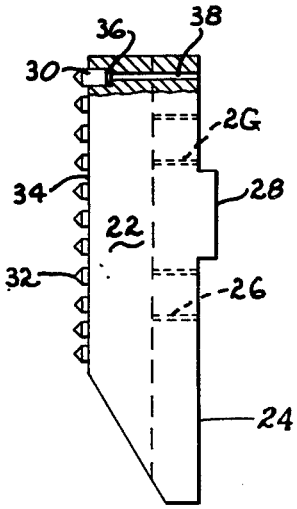
FIG. 2 is a side view of a gripper jaw according to the present invention.

Shown in FIG. 2 is a gripper jaw 22 according to the present invention and having a back face 24 which is adapted to mount upon a power arm 18 and having bolt holes 26 so that the gripper jaw may be securely fastened to power arm 18. The back face 24 has a vertical support protrusion 28 which helps support the load when vibratory head 10 is driving or extracting a pile 12.

Shown on the front of gripper jaw 22 are compacts 30 of hard wear resistant material, preferably, a cemented hard metal carbide, such as tungsten carbide. The compacts are preferably rod-like in configuration having a conical top portion 32 which terminates in a pointed apex section. The rod-like body of compact 30 is imbedded in the front face 34 of a gripper jaw 22 preferably by squeezing fit between the diameter of the hole 36 and the rod-like body of the compact 30.

If necessary, brazing or other means of fastening the compact 30 in hole 36 may be utilized.

In the present application, a compact 30 is press fitted into the hole 36 and a smaller bore 38 is provided so as to communicate to the back face 24 of gripper jaw 22. Advantageously, this hole may be used to help remove the bottom portion of compact 30 should the upper portion of compact 30 fracture during use. A tool (not shown) may be inserted through the bore 38 so as to push the compact 30 out of front face 34 of gripper jaw 22.

Figure 3:
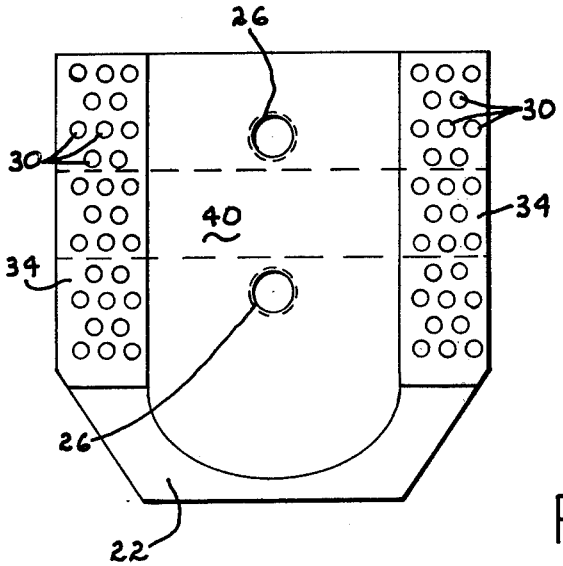
FIG. 3 is a front view of a gripper jaw according to the present invention.

Shown in FIG. 3 is a front view of the gripper jaw 22, shown in FIG. 2 having bolt holes 26 and compacts 30 imbedded in the front face 34 of the gripper jaw. Shown in FIG. 3, gripper jaw 22 has a throat area 40 which is necessary when gripper jaws are utilized upon caissons and other similar members.

Figure 4:
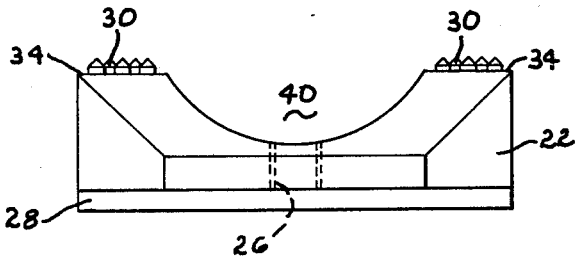
FIG. 4 is a top view of a gripper jaw according to the present invention.

Shown more clearly in FIG. 4, the throat area 40 is shown as a depression between the two portions of face portion 34.

Modifications may be made within the scope of the appended claims.

What is claimed is:

1. A gripping jaw for a driving/extracting head and comprising: a block-like body having a front face and a back face with said back face adapted for attachment to a powerdriven arm; said front face having holes formed therein and compacts of hard wear resistant material seated in said holes with an end of said compact protruding beyond said front face and bores smaller than said hole extending from said hole through said back face of said block.

2. A gripping jaw according to claim 1 in which said front face comprises two individual portions with compacts embedded therein and a throat area separating said individual portions.

3. A gripping jaw according to claim 1 which further includes the other end of said compact tapering inward as it extends away from the front face of the insert.

4. A gripping jaw according to claim 3 which further includes said compacts comprising a cemented hard metal carbide material.

5. A gripping jaw according to claim 4 in which said compacts comprise rod-like compacts having a length greater than its diameter.

6. A gripping jaw according to claim 5 in which the majority of the length of the compact is imbedded in said front face of said body.

* * * * *